US006278376B1

(12) United States Patent
Calamatas

(10) Patent No.: US 6,278,376 B1
(45) Date of Patent: Aug. 21, 2001

(54) TRAPPED OBJECT RELEASE SYSTEM FOR A TRANSIT VEHICLE DOOR

(75) Inventor: Philip J. Calamatas, Laval (CA)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/449,000

(22) Filed: Nov. 24, 1999

Related U.S. Application Data

(60) Provisional application No. 60/109,951, filed on Nov. 25, 1998.

(51) Int. Cl.[7] ..... G08B 21/00

(52) U.S. Cl. ..... 340/686.1; 340/686.4; 180/286; 49/117; 49/118

(58) Field of Search ..... 340/686.1, 686.4; 49/116, 117, 118, 119; 180/286

(56) References Cited

U.S. PATENT DOCUMENTS 5,076,016 * 12/1991 Adams et al. ..... 49/360
6,032,416 * 3/2000 Springer et al. ..... 49/119

* cited by examiner

*Primary Examiner*—Julie Lieu
(74) *Attorney, Agent, or Firm*—James Ray & Associates

(57) ABSTRACT

Method of facilitating release of an object caught by one or more closing transit vehicle door(s) in a motorized door system having a two stage lock, the two stage lock having a fully locked position and a pushback lock position. The method includes detecting the presence of the object by the effect of the object on either the position or the velocity of the door(s). The method also includes determining whether the door(s) are in a pushback range between the fully locked position and the pushback lock position. If an object is detected and the door(s) are in the pushback range, then one or more signals are supplied to a motor of the door(s) to move the door(s) in the door opening direction to or toward the pushback lock position.

14 Claims, 4 Drawing Sheets

TRAPPED OBJECT RELEASE SYSTEM FOR A TRANSIT VEHICLE DOOR

CROSS-REFERENCE TO RELATED APPLICATIONS

The invention described in this patent application is closely related to the following copending patent applications: TRANSIT VEHICLE DOOR, Ser. No. 09/099,260 filed Jun. 18, 1998now U.S. Pat. No. 6,032,416; provisional application: INTELLIGENT DOOR CONTROL UNIT, Serial # 60/109,951, filed Nov. 25, 1998; DYNAMIC BRAKE FOR POWER DOOR, Ser. No. 09/200,497, filed Nov. 25, 1998now U.S. Pat. No. 6,175,204; ENCODER TEST APPARATUS AND METHOD, Ser. No. 09/401,767 filed Sept. 23, 1999now U.S. Pat. No. 6,198,788; and to applications: SYSTEM FOR DETECTIONS OF OBSTRUCTIONS IN A MOTORIZED DOOR SYSTEM Ser. No. 09/448,999 and DOOR CONTROL SYSTEM, Ser. No. 09/448,782, which latter two applications are being filed concurrently herewith. The teachings of these referenced applications are herein incorporated into the present application by reference thereto. All of the referenced applications are assigned to the assignee of the present invention.

FIELD OF THE INVENTION

The present invention relates, in general, to control systems for motorized doors and, more particularly, the present invention relates to control systems for passenger transit type vehicle doors.

BACKGROUND OF THE INVENTION

Transit vehicle door systems must meet a number of conflicting requirements. They must operate quickly, to meet the pressures of urban mass transit, and they are subject to a number of safety requirements. One such requirement is that a passenger must not be able to fall out of the transit vehicle when it is in motion. Another requirement is that a passenger who has a body part, or clothing, caught by closing doors must be able to extricate the trapped body part or clothing. On a typical passenger transit train, the doors are not directly observed by the operator of the train.

It is known to provide transit vehicle doors which have resilient means disposed between the door, or doors, and a lock for the door(s) so that if a body part or garment of a passenger is caught by closing door(s), the passenger can force the door(s) open a small amount to a pushback position in order to extract the body part or garment. To do this, the passenger must overcome resilient forces, as well as the weight and friction of the door(s). With these prior art systems, the passenger may not exert enough force to open the door(s) sufficiently to extract the body part or garment. Serious injury or death may result.

SUMMARY OF THE INVENTION

In one aspect, the present invention is a method of facilitating release of an object caught by one or more closing transit vehicle door(s) in a motorized door system having a two stage lock, the two stage lock having a fully locked position and a pushback lock position. The method includes detecting the presence of the object by the effect of the object on either the position or the velocity of the door(s). The method also includes determining whether the door(s) are in a pushback range between the fully locked position and the pushback lock position. If an object is detected and the door(s) are in the pushback range, then one or more signals are supplied to a motor of the door(s) to move the door(s) in the door opening direction to or toward the pushback lock position.

In another aspect, the present invention is an apparatus for facilitating release of an object caught by one or more closing transit vehicle door(s) in a motorized door system having a two stage lock, the two stage lock having a fully locked position and a pushback lock position. The apparatus includes means disposed in a control system of the motorized door for detecting the object by the effect of the object on either the position of the door(s) or the velocity of the door(s). It also includes means for determining whether the door(s) are in a pushback range between the fully locked position and the pushback lock position. It further includes means for supplying one or more signals to the motor of the door system to move the door(s) in the door opening direction to or toward the pushback lock position, if the door(s) are in the pushback range and the object is detected.

OBJECTS OF THE INVENTION

It is therefore one of the primary objects of the present invention to provide a transit vehicle door system which operates quickly.

Another object of the present invention is to provide a trapped object release system for a transit vehicle door.

Still another object of the present invention is to provide a method of releasing a passenger's body part or garment portion which has been caught by closing transit vehicle doors.

Yet another object of the present invention is to provide a method of reducing the force needed to move transit vehicle door(s) from the closed position to a pushback position.

An additional object of the present invention is to eliminate the need for a passenger to overcome resilient forces to open a closed door sufficiently to extract a garment or trapped body portion.

A further object of the present invention is to provide a powered assist for moving transit vehicle door(s) from the closed position to a position which is sufficiently open that a person may extract a garment or trapped body portion.

It is an additional object of the present invention to provide a powered assist for moving transit vehicle door(s) from a closed position to a pushback position.

Yet another object of the present invention is to allow a controlled distance, upon pushback re-open, only large enough that the head of a child cannot pass through the resulting opening.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
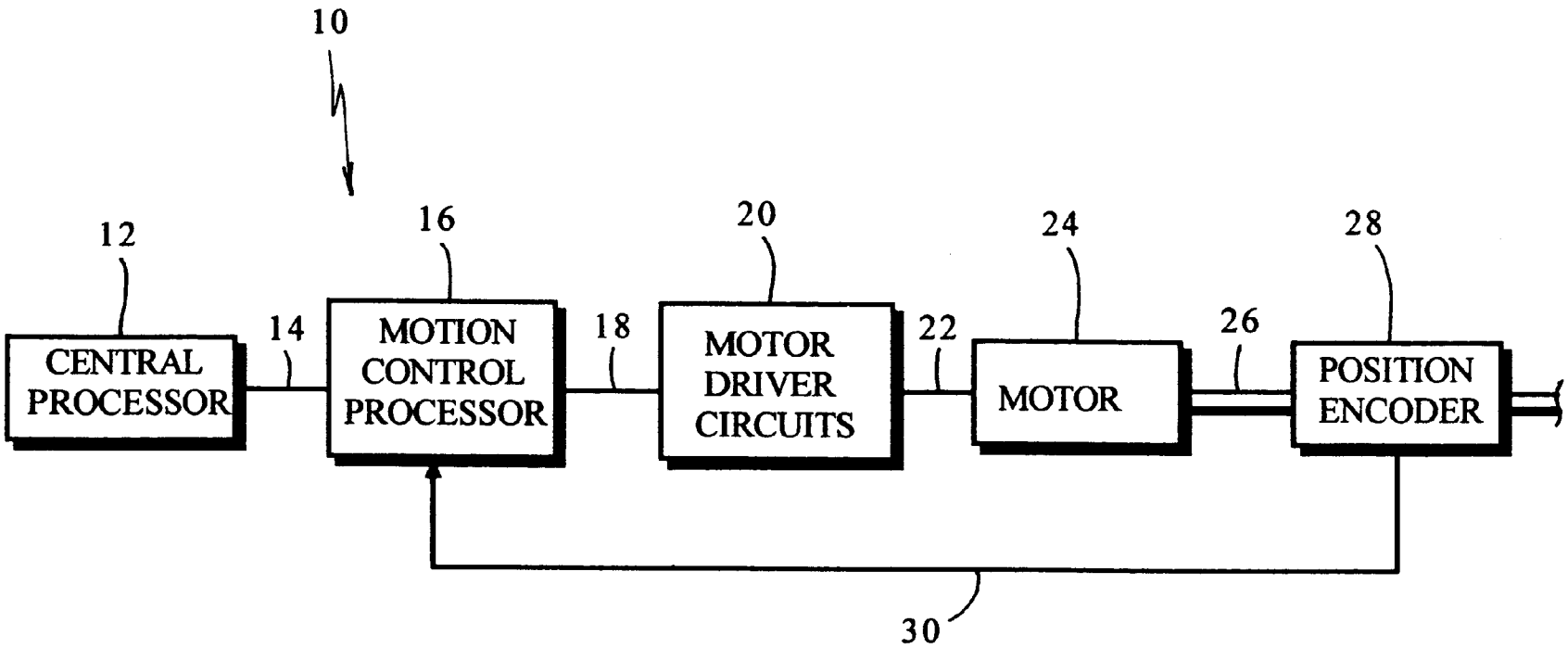
FIG. 1 is a schematic illustration of a presently preferred embodiment of the invention.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures for the sake of clarity and understanding of the invention.

Attention is now directed to FIG. 1 which illustrates an apparatus, generally designated 10, that controls the motorized door (not shown). Apparatus 10 includes a central processor 12 having a signal connection 14 to a motion control processor 16. Such central processor 12 may include, for example, a commercially available microprocessor of the type normally employed in personal computers such as the 8088, x386, x486, etc, or a micro-computer such as 68HC11, 8051, etc. Signal connection 14 may include a data bus, an address bus and one or more control lines. Motion control processor 16, preferably, is an LM629, which is employed in the robotics art for movement of objects having significant mass. Alternatively, there are other types of commercially available processors that may be used. Examples of these processors include fast microprocessors, RISC processors, Digital Signal Processors (DSP), etc.

Motion control processor 16 has a signal connection 18 to motor driver circuits 20 which have a connection 22 to motor 24. A person skilled in the art will recognize that these motor driver circuits 20 may, for example, include an H-bridge or any other type of motor power amplifier. Motor 24 has an output power rotor 26 and a rotary position encoder 28 which determines the rotary position of output power rotor 26 and, hence, defines the position of the door. Signals from encoder 28 are communicated to motion control processor 16 by signal connection 30.

Figure 2:
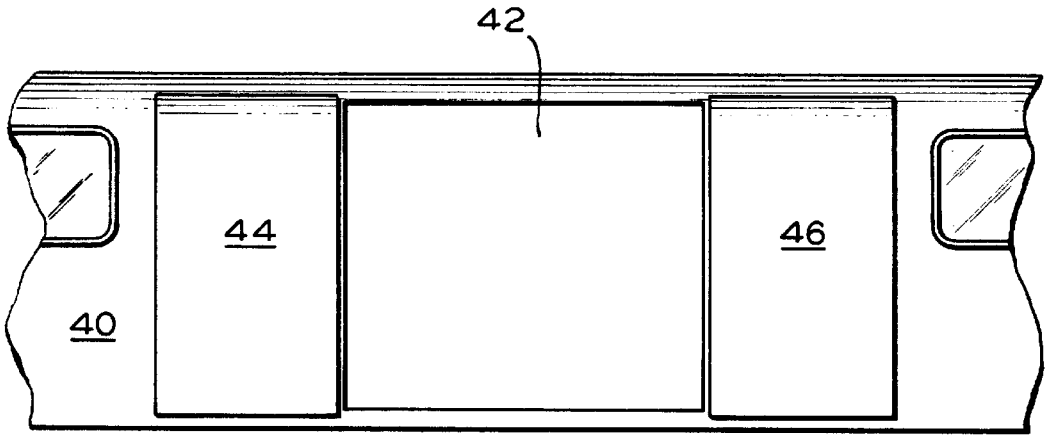
FIG. 2 is a schematic elevation drawing of a transit vehicle with biparting, door panels in an open position.
Figure 3:
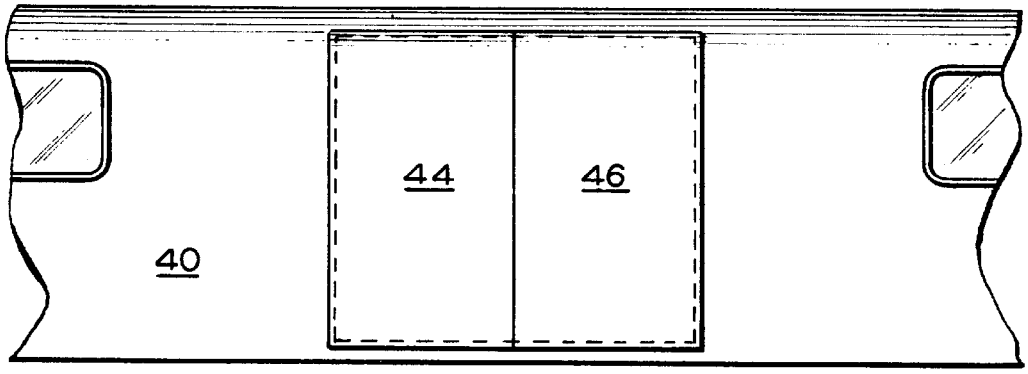
FIG. 3 is a schematic elevation drawing of the transit vehicle with biparting door panels in a closed position.
Figure 4:
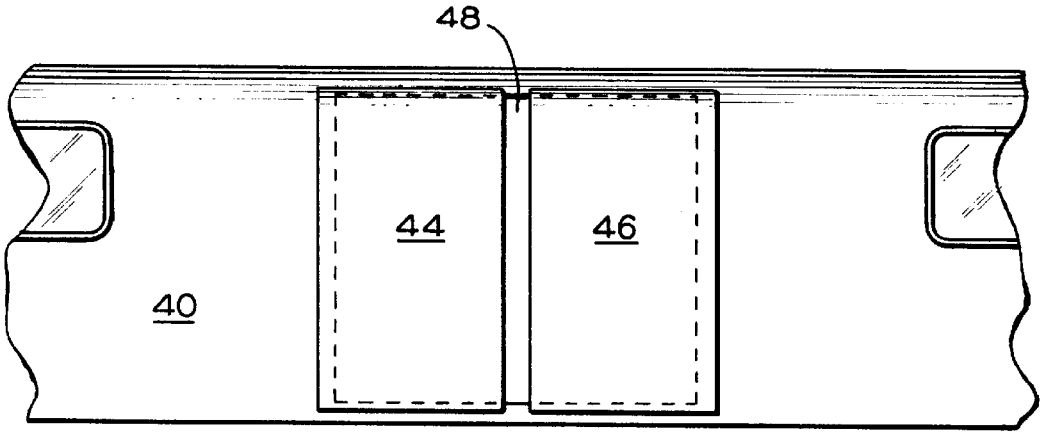
FIG. 4 is a schematic elevation drawing of the transit vehicle with biparting door panels in a pushback position.

Attention is now directed to FIGS. 2, 3 and 4 which show a biparting door system. A transit vehicle 40 has a door aperture 42 and biparting door panels 44 and 46. FIG. 2 shows the door panels 44 and 46 in an open position. FIG. 3 illustrates these door panels 44 and 46 in a closed position in which they cover such aperture 42. FIG. 4 shows the door panels 44 and 46 in a pushback lock position in which a gap 48 is provided between door panels 44 and 46 to enable extraction of an object trapped by door panels 44 and 46 when the panels are closed. Gap 48 is sufficiently small that a person cannot fall out of a transit vehicle 40 through gap 48.

The pushback lock is a mechanical lock which engages during a closing stroke when the door panels 44 and 46 reach the pushback lock position. The pushback lock provides a positive limit to the size of gap 48. The presently preferred pushback lock is a portion of a two stage lock which has both a fully locked position and a pushback lock position. It employs a lock arm having a pushback lock step, as well as a step for the fully locked position. When the lock arm rotates downward, the pushback lock step or the step for the fully locked position will engage a door hanger of door panel 44 or 46. Details of the preferred pushback lock are presented in the copending patent application: TRANSIT VEHICLE DOOR, Ser. No. 09/099,260, filed on Jun. 18, 1998. Preferably, two lock arms are provided, engaging the respective hangers of the door panels 44 and 46.

Figure 5:
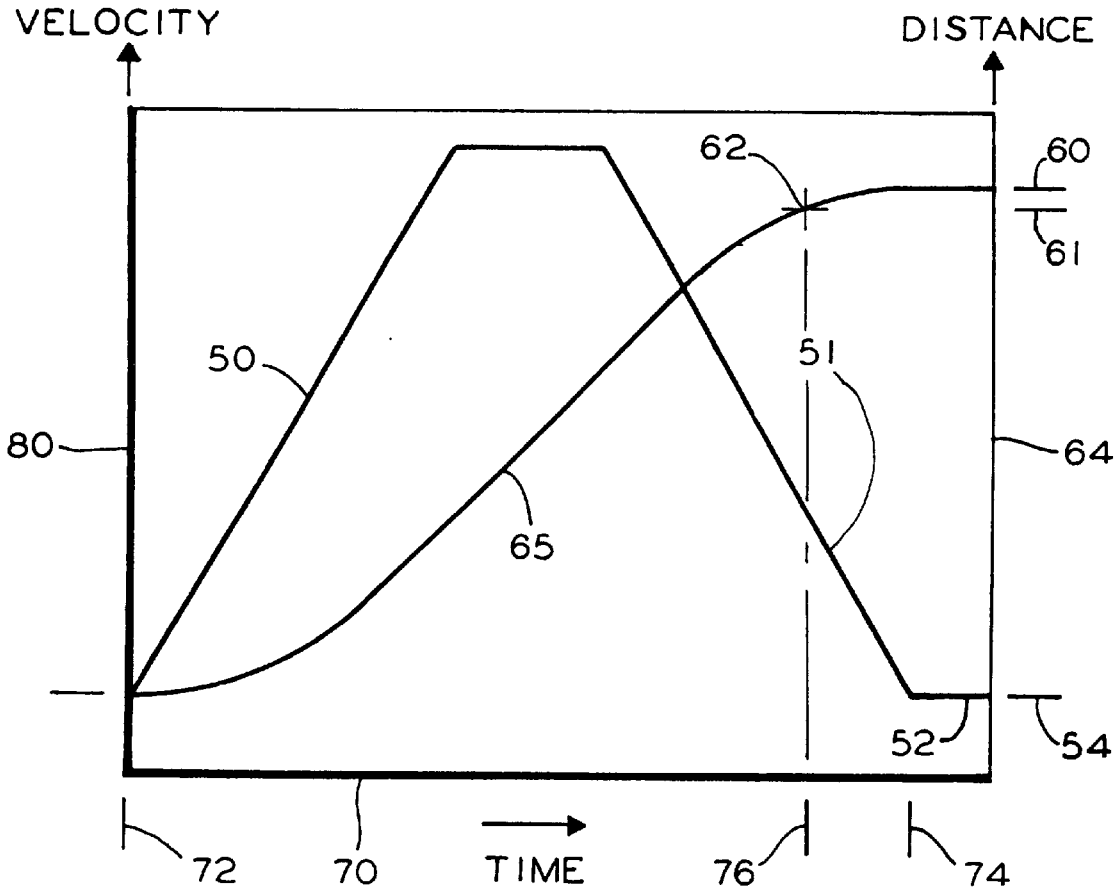
FIG. 5 is a plot showing profiles of door velocity and position during a stroke of the door(s).

FIG. 5 is a plot illustrating the profiles of position and velocity during a closing stroke of the door(s). The time axis is denoted 70 and the velocity axis for velocity profile, generally denoted 50, is denoted 80. A profile for distance travelled by the doors is generally denoted 65. The position axis for such distance profile 65 is denoted 64. The zero for both the velocity axis 80 and the distance axis 64 is denoted 54.

For the case of two biparting door panels, it is preferred that they be mechanically connected so that they move simultaneously in opposite directions. The distance axis in FIG. 5 may be considered to represent the position of one of the two doors, or it may be considered to represent the angle through which output power rotor 26 has been rotated.

The closing stroke begins at a time 72 and ends at a time 74. During that time, the position 64 goes from the zero position 54, which is the fully open position shown in FIG. 2, to the closed position 60 which is shown in FIG. 3.

The pushback lock position is denoted 61. Biparting door panels 44 and 46 in this position are illustrated in FIG. 4. The gap 48 is provided between door panels 44 and 46 when the door panels 44 and 46 are in the pushback lock position.

The position profile 65 reaches the pushback lock position 61 at the point 62, which occurs at the time 76. Segment 51 of velocity profile 50 denotes a portion of the door closing cycle subsequent to time 76 while door panels 44 and 46 are still in motion. Segment 52 of velocity profile 50 denotes a time when such door panels 44 and 46 have stopped.

The present invention applies to segments 51 and 52 of velocity profile 50. When door panels 44 and 46 are in a pushback range, which lies between position 61 and position 62, and an obstruction is detected, the door panels 44 and 46 are moved to the pushback lock position 61 so that gap 48 is provided to facilitate extraction of a trapped portion of a person or garment.

When the closing door panels 44 and 46 reach point 62, the pushback lock (not shown) is engaged and door panels 44 and 46 cannot be moved to positions 64 or more open than the pushback lock position 61. This is to prevent a person from falling out of transit vehicle 40 after the door panels 44 and 46 are closed to the pushback lock position 61.

Figure 6:
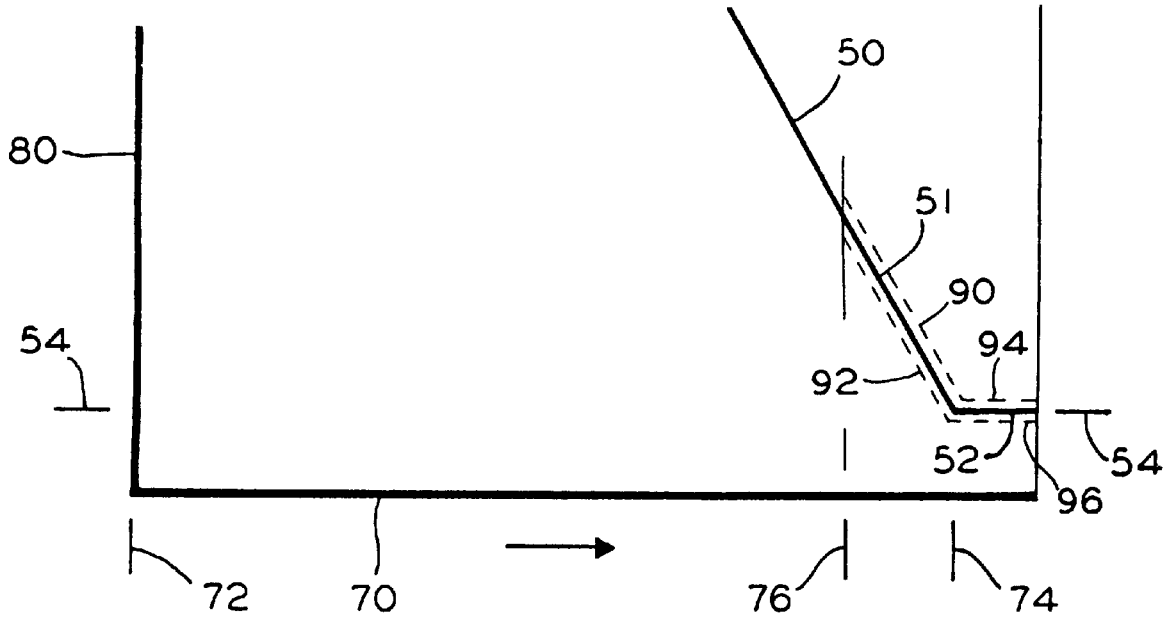
FIG. 6 is a plot showing portions of the velocity profile when the door has reached the pushback range.

FIG. 6 shows allowable limits for segments 51 and 52 of velocity profile 50. In segment 51, the door panels have reached the pushback lock position 61, but the panels are not yet stopped. In segment 52, the panels have been stopped. An upper limit 90 and a lower limit 92 for the velocity of door panels 44 and 46 on segment 51 are shown. If the actual velocity goes above upper limit 90 or below lower limit 92, a brake is activated to stop door panels 44 and 46 and then panels 44 and 46 are moved to the pushback lock position 61 which provides the gap 48 to facilitate removal of a portion of a person or garment. Preferably, the brake is a dynamic brake as described in the application: DYNAMIC BRAKE FOR POWER DOOR, Ser. No. 09/200,497 which was referenced above.

After the closing stroke has ended at time 74, segment 52 denotes the stopped portion of profile 50. If an obstruction causes the door panels 44 and 46 to move above the upper velocity limit 94 or below the lower velocity limit 96, then the doors are moved to pushback lock position 61, which provides such gap 48 to facilitate removal of a portion of the person or garment.

Figure 7:
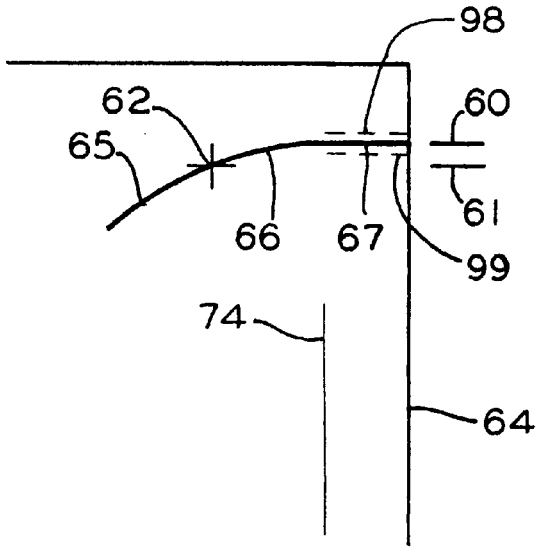
FIG. 7 is a plot showing upper and lower position limits for the door panels after the conclusion of a closing stroke.

In the presently preferred embodiment, an obstruction after the doors are stopped is detected by a change in position of the door panels 44 and 46. FIG. 7 shows portions 66 and 67 of distance profile 65. Segment 66 begins at point 62 when the door panels 44 and 46 reach pusliback lock position 61. In segment 66, the door panels 44 and 46 are still moving. Segment 66 corresponds to velocity segment 51 shown in FIG. 6. After the door panels 44 and 46 are completely stopped, at time 74, the position 65 of panels 44 and 46 remains constant. This segment is denoted 67. This segment applies to the door panels 44 and 46 after they are stopped and before they are completely locked.

If, when the door panels 44 and 46 are on segment 67, even if a very slight movement of panels 44 and 46 occurs, that event is taken to be an indication that an obstruction has been encountered. That is to say, that a portion of a person, a garment, etc., has been caught between the closing door panels 44 and 46. FIG. 7 shows an upper position limit 98 and a lower position limit 99. If the position of panels 44 and 46 reaches either limit, then at least one signal is sent to motor 24 to move door panels 44 and 46 to the pushback position 61. Since door panels 44 and 46 have been stopped, any further movement is an indication that an obstruction has been detected, it is preferred that upper and lower position limits 98 and 99 correspond to only a very few pulses of position encoder 28.

Preferably, this is accomplished by defining a stroke in the central processor 12 which moves door panels 44 and 46 to pushback position 61. This stroke is then communicated to motion control processor 16 which controls the movement of door panels 44 and 46 to pushback position 61.

In the preceding discussion, a door system having biparting panels 44 and 46 has been discussed. In an alternative embodiment, the invention may be applied to a single door system.

While a presently preferred and various additional alternative embodiments of the instant invention have been described in detail above in accordance with the patent statutes, it should be recognized that various other modifications and adaptations of the invention may be made by those persons who are skilled in the relevant art without departing from either the spirit of the invention or the scope of the appended claims.

I claim:

1. A method of facilitating release of an object caught by at least one closing transit vehicle door in a motorized door system having a two stage lock, said two stage lock having a fully locked position and a pushback lock position, said method comprising the steps of:

(a) detecting a presence of said object by an effect of said object on at least one of a position of said at least one door and a velocity of said at least one door;

(b) determining whether said at least one door is in a pushback range between said fully locked position and said pushback lock position; and (c) supplying at least one signal to a motor of said at least one door, said at least one signal defining a stroke in a door opening direction of said at least one door to move said at least one door to a position one of at and near said pushback lock position, if said at least one door is in said pushback range and said object is detected.

2. A method, according to claim 1, further comprising the step of applying a brake of said door to stop said at least one door if said at least one door is moving in a closing direction when said object is detected.

3. A method, according to claim 2, wherein said at least one signal defines said stroke in said opening direction of said at least one door from a position of said at least one door after said brake has stopped said at least one door to said position one of at and near said pushback position.

4. A method, according to claim 1, wherein step (a) is further characterized in that said effect of said object on said position of said at least one door is determined by a position encoder for said motor of said at least one door.

5. A method, according to claim 1, wherein a door trajectory profile for said stroke is generated in a central processor of said motorized door system and communicated to a motion control processor which provides feedback control of said stroke.

6. A method, according to claim 1, further comprising determining whether a closing stroke has been completed and in that case setting upper and lower position limits for said at least one door and supplying said signal if a position of said at least one door moves beyond one of said upper and lower position limits.

7. A method, according to claim 6, wherein said upper and lower position limits correspond to only a very few pulses of a position encoder for said at least one door.

8. An apparatus for facilitating release of an object caught by at least one closing transit vehicle door in a motorized door system having a two stage lock, such two stage lock having a fully locked position and a pushback lock position, said apparatus comprising:

(a) means disposed in a control system of such motorized door for detecting a presence of such object by an effect of such object on at least one of a position of such at least one door and a velocity of such at least one door;

(b) means disposed in such control system for determining whether such at least one door is in a pushback range between such fully locked position and such pushback lock position; and (c) means disposed in such control system for supplying at least one signal to a motor of such at least one door, said at least one signal defining a stroke in a door opening direction of such at least one door to move such at least one door to a position one of at and near such pushback lock position, if such at least one door is in such pushback range and such object is detected.

9. An apparatus, according to claim 8, further comprising means for applying a brake of such at least one door to stop such at least one door if such at least one door is moving in a closing direction when such object is detected.

10. An apparatus, according to claim 8, wherein said apparatus is further characterized in that said at least one signal defines said stroke in such opening direction of such at least one door from a position of such at least one door when such object is detected to such position one of at and near such pushback lock position.

11. An apparatus, according to claim 8, further characterized in that a position of such door(s) is indicated by a position encoder for such motor of such door(s), such position encoder being connected to such control system.

12. An apparatus, according to claim 10, wherein said apparatus is further characterized in that a door trajectory profile for said stroke is generated in a central processor of such motorized door system and communicated to a motion control processor which provides feedback control of said stroke.

13. An apparatus, according to claim 8, further comprising means disposed in said control system for determining whether a closing stroke has been completed, and if such closing stroke has been completed, setting upper and lower position limits for such at least one door and supplying said signal if a position of such at least one door moves beyond one of said upper and lower position limits.

14. An apparatus, according to claim 13, wherein said apparatus is further characterized in that said upper and lower position limits correspond to only a very few pulses of a position encoder for such at least one door.

* * * * *